US008042255B1

(12) United States Patent
Jevnager

(10) Patent No.: US 8,042,255 B1
(45) Date of Patent: Oct. 25, 2011

(54) RAPID FABRICATION TECHNIQUES FOR ARBITRARY SHAPE PIEZOELECTRIC TRANSDUCER SENSORS

(75) Inventor: Michael D. Jevnager, Rindge, NH (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 652 days.

(21) Appl. No.: 12/287,164

(22) Filed: Sep. 30, 2008

(51) Int. Cl.
*H04R 23/00* (2006.01)

(52) U.S. Cl. ..... 29/594; 29/592.1; 29/25.35; 29/595; 29/609.1; 427/100; 427/262; 381/190

(58) Field of Classification Search ..... 29/25.35, 29/594; 427/100
See application file for complete search history.

(56) References Cited

U.S. PATENT DOCUMENTS 5,825,902 A * 10/1998 Fujishima ..... 381/190
6,060,818 A * 5/2000 Ruby et al. ..... 310/363

* cited by examiner

*Primary Examiner* — Richard Crispino
*Assistant Examiner* — Vicki Wu
(74) *Attorney, Agent, or Firm* — James M. Kasischke; Michael P. Stanley; Jean-Paul A. Nasser

(57) ABSTRACT

The present invention provides methods for making an acoustic transducer. In one possible embodiment, a rigid inner shell is provided with a conductive exterior surface. Masking material is applied onto a first location on the conductive exterior surface of the rigid inner shell. Piezoelectric material is deposited over the conductive exterior surface of the rigid inner shell and the masking material. Conductive material is deposited onto the piezoelectric material. The masking material is removed. A first signal lead is attached to the first location on the conductive exterior surface of the rigid inner shell. A second signal lead is attached to the conductive material.

14 Claims, 1 Drawing Sheet

FIGURE
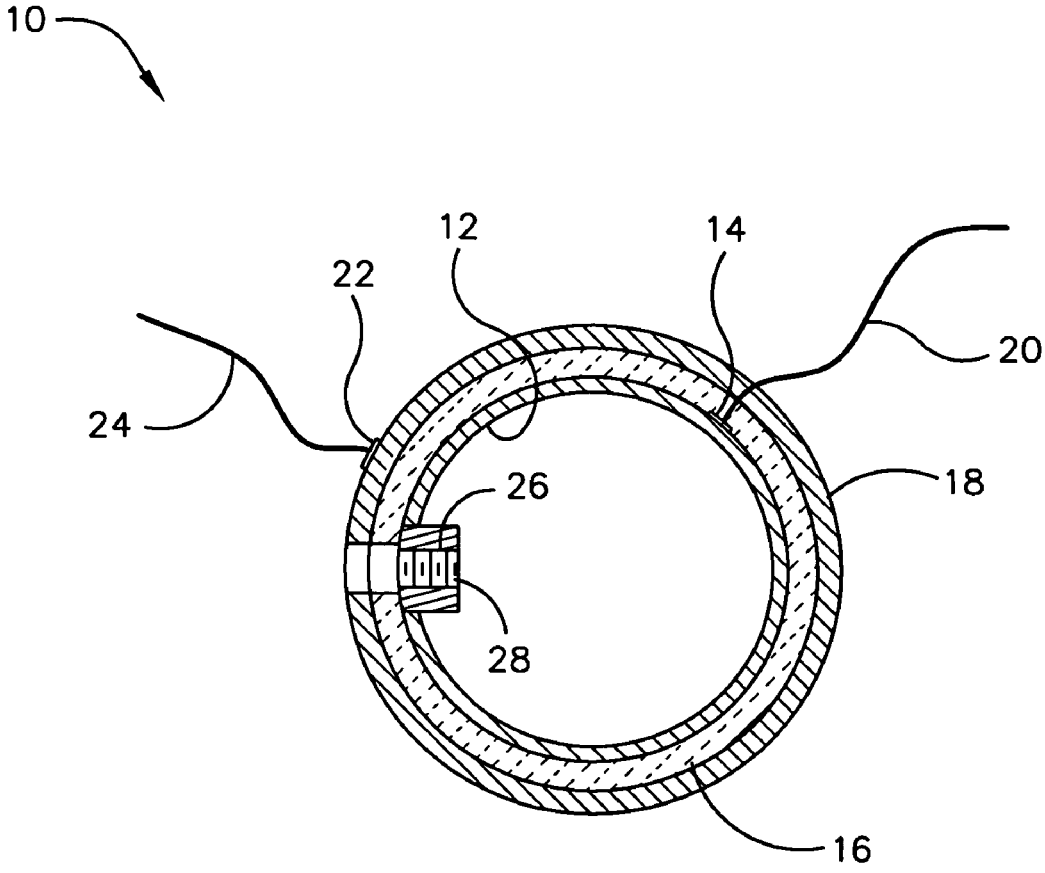

RAPID FABRICATION TECHNIQUES FOR ARBITRARY SHAPE PIEZOELECTRIC TRANSDUCER SENSORS

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

None.

BACKGROUND OF THE INVENTION (1) Field of the Invention

The present invention relates generally to methods for rapidly making piezoelectric transducers using piezoelectric material. In one possible embodiment, the invention is directed to a method for building a transducer onto an inner form with a conductive surface.

(2) Description of the Prior Art

In the past, piezoelectric transducers have been produced using flat sheets of material that are cut into segments and adhesively bonded to a desired configuration.

The following U.S. patents describe various prior art transducer systems. However, as discussed below, transducers made by some of the following prior art methods may be unsuitable for use in underwater environments where pressures are encountered.

U.S. Pat. No. 4,787,126, issued Nov. 29, 1988, to Oliver, discloses a dark field ultrasonic transducer that is constructed with an outer annular spherical or conical transducer element and an inner spherical element. The outer annular element is excited and insonifies a small portion of a part surface near a discontinuity or crack with longitudinal waves or with surface waves. The inner dark field element is not focused to be sensitive to either reflected sound or waves reradiated from the surface waves, but detects sound scattered from surface discontinuities such as a crack edge. When surface waves strike a crack edge and restrikes it after reflection from the bottom of the crack, two pulses are received and the time delay between them is a measure of crack depth. The crack shape and crack depth profile are determined as the part is scanned. A sphere-cone transducer, the preferred embodiment, is fabricated by stretching thin piezoelectric polymer film over a tool having a ball embedded in a conical surface.

U.S. Pat. No. 5,825,902, issued Oct. 20, 1998, to Fujishima, discloses a spherical piezoelectric speaker having a small and simple structure, a wide sound frequency range and a high sound pressure includes a spherical shell piezoelectric ceramic body which is hollow inside and an external electrode and an internal electrode defining a driving device for oscillating the spherical shell piezoelectric ceramic body. A sound absorber is provided in a hollow section of the piezoelectric ceramic body and a frame for holding the piezoelectric ceramic body is disposed on the outer surface of the piezoelectric ceramic body via dampers for reducing an influence of external oscillation.

U.S. Pat. No. 6,215,231, issued Apr. 10, 2001, to Newnham et al, discloses an electroactive device incorporating the invention that is conFIGUREd from an electroactive ceramic hollow sphere having an inner surface, an outer surface, a wall thickness aspect and a radius aspect. Conductive electrodes are positioned on opposed surfaces of said sphere and conductors enable application of an electrical potential between the conductive electrodes to enable a field to be applied to the sphere that causes a dimension change in the radius aspect and thickness aspect thereof.

U.S. Pat. No. 6,654,993, issued Dec. 2, 2003, to Zhang et al, discloses a process for fabricating a ceramic electroactive transducer of a predetermined shape. The process comprises the steps of providing a suitably shaped core having an outer surface, attaching a first conductor to the outer surface of the core, coating an inner conductive electrode on the outer surface of the core such that the inner conductive electrode is in electrical communication with the first conductor, coating a ceramic layer onto the inner electrode, thereafter sintering the ceramic layer, coating an outer electrode onto the sintered ceramic layer to produce an outer electrode that is not in electrical communication with the first conductor, and then poling the sintered ceramic layer across the inner electrode and the outer electrode to produce the ceramic electrode.

U.S. Pat. No. 7,019,445, issued Mar. 28, 2006, to Zhang et al, discloses a'process for fabricating a ceramic electroactive transducer of a predetermined shape. The process comprises the steps of providing a suitably shaped core having an outer surface, attaching a first conductor to the outer surface of the core, coating an inner conductive electrode on the outer surface of the core such that the inner conductive electrode is in electrical communication with the first conductor, coating a ceramic layer onto the inner electrode, thereafter sintering the ceramic layer, coating an outer electrode onto the sintered ceramic layer to produce an outer electrode that is not in electrical communication with the first conductor, and then poling the sintered ceramic layer across the inner electrode and the outer electrode to produce the ceramic electrode.

The above cited prior art does not disclose a transducer made utilizing a hollow metallic form. For example, Zhang et al., U.S. Pat. No. 6,654,993 and Zhang et al., U.S. Pat. No. 7,019,445 propose a spherical transducer made from a piezoelectric ceramic.

Moreover, the inner metallic coating used by Zhang is simply a metallic coating that is not sufficiently thick to be strong enough to provide support. Instead, Zhang utilizes ceramic as the structural material. Use in underwater environments where pressure is encountered is likely to be problematic and may crush, crack or deform the ceramic material of the Zhang transducer.

Consequently, those skilled in the art will appreciate the present invention that addresses the above and other problems.

SUMMARY OF THE INVENTION

It is a general purpose of the present invention to provide an improved method for making acoustic transducers.

An object of the present invention is to provide an improved acoustic transducer.

Another object of the present invention is to provide a more rapid method for making acoustic transducers.

Accordingly, the present invention provides methods for making an acoustic transducer. In one possible embodiment, steps may comprise providing a rigid inner shell with a conductive exterior surface and applying masking material onto a first location on the conductive exterior surface of the rigid inner shell. In one embodiment, steps may comprise depositing piezoelectric material over the conductive exterior surface of the rigid inner shell and the masking material. Steps may also comprise depositing conductive material onto the piezoelectric material. In one embodiment, the method may comprise removing the masking material from the first location on the conductive exterior surface of the rigid inner shell. In another embodiment, the method may comprise attaching a first signal lead to the first location on the conductive exterior surface of the rigid inner shell and/or attaching a second signal lead to the conductive material. The method may comprise providing that the rigid inner shell is hollow prior to the step of depositing piezoelectric material over the conductive exterior surface of the rigid inner shell and the masking material.

The method may comprise applying the masking material onto a second location on the conductive exterior surface of the rigid inner shell, removing the masking material from the second location, and/or forming a port at the second location wherein the port leads to an interior of the rigid inner shell.

The method may comprise providing that the inner shell is sufficiently strong for use in an underwater environment.

The method may comprise forming at least one port in communication with an interior of the inner shell.

The method may further comprise introducing at least one of heating fluid or cooling fluid through at least one port.

The method may comprise forming threads within at least one port. The method may comprise utilizing the threads as a mounting to hold the inner shell during the making of the transducer.

The method may comprise utilizing a port for pressure balancing of the acoustic transducer for use underwater.

The method may comprise applying an electrically insulating and moisture resistant coating over the conductive material.

The method may comprise forming the rigid inner shell from a metallic material. The metallic material might comprise copper greater than 0.0005 inches in thickness. The metallic material might comprise steel or other metallic material greater than 0.0005 inches in thickness.

The method may comprise forming the rigid inner shell from at least one of fiberglass, rubber, glass, or composite material, which may be coated with conductive material.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing, wherein like reference numerals refer to like parts and wherein:

The FIGURE is an elevational view, in cross-section, showing a piezoelectric acoustic sensor in accord with one possible embodiment of the present invention.

DETAILED DESCRIPTION OF THE INVENTION

The present invention may be utilized for rapidly fabricating piezoelectric acoustic sensors. Not only are the acoustic sensors rapidly produced, they are far superior to sensors constructed by cut and bond methods whereby flat sheets of material are cut into segments and adhesively bonded to a desired configuration, as discussed hereinbefore.

The FIGURE illustrates transducer 10 that may be rapidly produced using a fabrication technique in accord with one possible embodiment of the present invention. In this example, transducer 10 is spherical. However, other shapes for the transducers may include but are not limited to cylinders, cubes, rectangles, and the like. The method of the present invention may produce a transducer of any shape into which inner shell 12 may be formed.

Inner shell 12 can be any rigid material as dictated by structural considerations. Inner shell 12 may be hollow as indicated and as further discussed below with various advantages for this construction. Structural considerations might include, for instance, operating in underwater environments wherein significant pressure and/or water currents may be found. Copper or copper alloy comprises one possible preferred rigid material because of its electrical conductivity. In one possible embodiment, the copper material thickness of inner shell 12 might be greater than 0.001 inches or 0.0005 inches. (Note that the FIGURE is not intended to be representative of actual dimensions.) In another embodiment, stainless steel greater than 0.001 inches or 0.0005 inches could also be used but may need copper coating. Metallic coatings may often be less than 0.0005 inches, may be better measured in microns, and may be less than 100 microns. However, the invention is not limited to the above dimensions.

A suitable rigid material such as fiberglass, rubber or glass may be used to form a portion of inner shell 12. Non-conductive rigid materials may be utilized as long as the material may be coated with metal to provide a conductive outer surface. While, the material for the internal spherical shell is not necessarily critical, the material should be sufficiently strong to resist forces of the environment in which transducer 10 operates.

A spot or masking region, such as spot or masking region 14, on an outside surface of inner shell 12 may be selected and covered with a masking material. Masking can be performed at room temperature utilizing vulcanizing silicone as the masking material. However, other masking materials such as non-corrosive masking materials may be used. The masking material may be removed later in the process as discussed hereinafter.

Piezoelectric layer 16 of piezoelectric material, such as piezoelectric copolymer, VF2-TrFE, may be flame sprayed over the entire outer surface of inner shell 12. Piezoelectric layer 16 can be deposited by any process that allows control over the thickness of the material. Thickness is typically important for properly optimizing the transducer. Known spraying processes having these characteristics include flame spraying and ordinary spraying. In flame spraying, combustion of a gaseous fuel may be used to carry the copolymer piezoelectric material to the shell. In the ordinary spraying process, the piezoelectric material may be mixed with a solvent and sprayed on the shell.

Outer metal layer 18 can then be deposited over the piezoelectric layer 16. Outer metal layer 18 can be applied by flame spraying or sputtering. The primary reason for outer metal layer 18 is to provide a contact on the outer surface of transducer 10. If required, cooling fluid could be circulated through port 28 to control temperature within transducer 10 during these processes.

In one possible embodiment, the masking material and the material deposited onto spot or masking region 14 may then be removed, exposing the metal surface of the inner shell 12. Signal leads 20 and 24 may be secured to spot or masking region 14 and to spot or region 22. For example region 22 may comprise solder or other means for attaching wire 24. If desired, contact poling leads and/or signal leads 20 and 24 might be utilized to apply a voltage to polarize the piezoelectric layer 16.

If required, a conformal coating may be applied over the outside of transducer 10 to provide an electrically insulating and moisture resistant barrier.

In order to form at least one port 28 in accord with one possible embodiment, a portion of inner shell 12 might be, masked before deposition of piezoelectric layer 16. If additional ports are desired, corresponding regions may also be masked. The masking prevents deposition of piezoelectric layer 16 at the port region wherein port 28 is formed. Other means to form at least one port 28 might also be utilized.

If utilized, port 28 may serve many uses. Port 28 may be used to hold inner shell 12 while the layers are applied. Heating and cooling may be accomplished through port 28 or multiple ports 28, if required. If inner shell 12 is solid, a tapped hole with threads 26 can be used to provide a holding and mounting point for fabrication and installation. When transducer 10 is hollow and used under pressure circumstances, port 28 may be used to pressure compensate (balance) transducer 12.

In summary, the present invention provides methods for making an acoustic transducer. In one possible embodiment, steps might comprise providing a rigid inner shell with a conductive exterior surface and applying masking material onto a first location on the conductive exterior surface of the rigid inner shell. In one embodiment, steps may comprise depositing piezoelectric material over the conductive exterior surface of the rigid inner shell and the masking material. Steps may also comprise depositing conductive material onto the piezoelectric material. In one embodiment, the method may comprise removing the masking material from the first location on the conductive exterior surface of the rigid inner shell. In another embodiment, the method may comprise attaching a first signal lead to the first location on the conductive exterior surface of the rigid inner shell and/or attaching a second signal lead to the conductive material.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A method for making an acoustic transducer, comprising:

providing a rigid inner shell with a conductive exterior surface;

applying masking material onto a first location on said conductive exterior surface of said rigid inner shell;

depositing piezoelectric material over said conductive exterior surface of said rigid inner shell and said masking material;

depositing conductive material onto said piezoelectric material;

removing said masking material from said first location on said conductive exterior surface of said rigid inner shell;

attaching a first signal lead to said first location on said conductive exterior surface of said rigid inner shell; and attaching a second signal lead to said conductive material.

2. The method of claim 1, wherein said provided rigid inner shell is hollow.

3. The method of claim 2, further comprising:

applying said masking material onto a second location on said conductive exterior surface of said rigid inner shell prior to said step of depositing piezoelectric material;

removing said masking material from said second location after said step of depositing conductive material; and forming a port at said second location wherein said port leads to an interior of said rigid inner shell.

4. The method of claim 1, further comprising providing that said rigid inner shell is sufficiently strong for use in an underwater environment.

5. The method of claim 2, further comprising forming at least one port in communication with an interior of said rigid inner shell.

6. The method of claim 5, further comprising introducing at least one of heating fluid or cooling fluid into said rigid shell interior through said at least one port.

7. The method of claim 5, further comprising forming threads in said rigid inner shell within said at least one port.

8. The method of claim 7, further comprising utilizing said threads as a mounting to hold said rigid inner shell.

9. The method of claim 5, further comprising the step of pressure balancing said acoustic transducer.

10. The method of claim 1, further comprising applying an electrically insulating and moisture resistant coating over said deposited conductive material.

11. The method of claim 1, wherein said step of providing a rigid inner shell comprises forming said rigid inner shell from a metallic material.

12. The method of claim 11, wherein said metallic material is greater than 0.0005 inches in thickness.

13. The method of claim 11, wherein said metallic material is selected from steel and copper.

14. The method of claim 1, wherein said step of providing a rigid inner shell comprises:

forming said rigid inner shell from at least one of fiberglass, rubber, glass, or composite material; and coating said rigid inner shell with conductive material.

* * * * *